US007837310B2

(12) United States Patent
Higginson et al.

(10) Patent No.: US 7,837,310 B2
(45) Date of Patent: Nov. 23, 2010

(54) FLUID DEPOSITION DEVICE

(75) Inventors: John A. Higginson, Santa Clara, CA (US); Michael Rocchio, Hayward, CA (US); Jeffrey Birkmeyer, San Jose, CA (US); Stephen R. Deming, San Jose, CA (US); Kevin Von Essen, San Jose, CA (US); Andreas Bibl, Los Altos, CA (US); Deane A. Gardner, Cupertino, CA (US); Daniel Alan West, Monte Sereno, CA (US)

(73) Assignee: Dimatix, Inc., Lebanon, NH (US)

( * ) Notice: Subject to any disclaimer, the term of this patent is extended or adjusted under 35 U.S.C. 154(b) by 1136 days.

(21) Appl. No.: 11/457,022

(22) Filed: Jul. 12, 2006

(65) Prior Publication Data

US 2007/0013736 A1 Jan. 18, 2007

Related U.S. Application Data

(60) Provisional application No. 60/699,436, filed on Jul. 13, 2005.

(51) Int. Cl.
*B41J 2/175* (2006.01)

(52) U.S. Cl. ..... 347/86

(58) Field of Classification Search ..... 347/86, 347/29, 32

See application file for complete search history.

(56) References Cited

U.S. PATENT DOCUMENTS

| | | | | |
|---|---|---|---|---|
| 5,617,128 | A * | 4/1997 | Thoman et al. | 347/87 |
| 5,682,186 | A * | 10/1997 | Bohorquez et al. | 347/29 |
| 6,250,747 | B1 * | 6/2001 | Hauck | 347/86 |
| 6,578,945 | B2 * | 6/2003 | Hashi et al. | 347/22 |
| 2002/0132052 | A1 | 9/2002 | Kumar et al. | |
| 2004/0096586 | A1 | 5/2004 | Schulberg et al. | |
| 2007/0026151 | A1 * | 2/2007 | Higginson et al. | |

FOREIGN PATENT DOCUMENTS

| | | |
|---|---|---|
| EP | 0 496 533 | 7/1992 |
| EP | 1 092 546 | 4/2001 |
| EP | 1 232 871 | 1/2002 |
| EP | 1 524 120 | 4/2005 |

OTHER PUBLICATIONS

International Search Report and Written Opinion of the International Searching Authority, PCT Application Serial No. PCT/US2006/027081, Mar. 22, 2007, 11 pp.

(Continued)

*Primary Examiner*—Shih-Wen Hsieh
(74) *Attorney, Agent, or Firm*—Fish & Richardson P.C.

(57) ABSTRACT

A fluid deposition device including a platen and a cartridge mount assembly is described. The platen is configured to support a substrate upon which a fluid will be deposited. The cartridge mount assembly includes a receptacle configured to receive a print cartridge and multiple electrical contacts configured to mate with corresponding electrical contacts on the print cartridge. In one implementation, the cartridge mount assembly further includes a vacuum connector configured to mate with a vacuum inlet included on the print cartridge. When the print cartridge is received in the receptacle, the print cartridge can form connections with the electrical contacts and with the vacuum connector of the receptacle at substantially the same time.

10 Claims, 13 Drawing Sheets

OTHER PUBLICATIONS

Communication Relating to the Results of the Partial International Search, Jan. 30, 2007, International Application No. PCT/US2006/027077, 3 pp.

Examination Report (translation) dated Jul. 31, 2009 from Chinese Application No. 200680030406.8, 4 pages.

Examination Report (translation) dated Jul. 10, 2009 from Chinese Application No. 200680030285.7, 7 pages.

* cited by examiner

FLUID DEPOSITION DEVICE

CROSS REFERENCE TO RELATED APPLICATION

This application claims priority to pending U.S. Provisional Application Ser. No. 60/699,436, entitled "Fluid Deposition Device", filed on Jul. 13, 2005, the entire contents of which are hereby incorporated by reference.

TECHNICAL FIELD

The following description relates to a system for depositing a fluid on a substrate.

BACKGROUND

An example of a fluid deposition device is an ink jet printer. An inkjet printer typically includes an ink path from an ink supply to an ink nozzle assembly that includes nozzles from which ink drops are ejected. Ink drop ejection can be controlled by pressurizing ink in the ink path with an actuator, which may be, for example, a piezoelectric deflector, a thermal bubble jet generator, or an electrostatically deflected element. A typical printhead has a line of nozzles with a corresponding array of ink paths and associated actuators, and drop ejection from each nozzle can be independently controlled. In a so-called "drop-on-demand" printhead, each actuator is fired to selectively eject a drop at a specific pixel location of an image, as the printhead and a printing media are moved relative to one another.

A printhead can include a semiconductor printhead body and a piezoelectric actuator, for example, the printhead described in Hoisington et al., U.S. Pat. No. 5,265,315. The printhead body can be made of silicon, which is etched to define ink chambers. Nozzles can be defined by a separate nozzle plate that is attached to the silicon body. The piezoelectric actuator can have a layer of piezoelectric material that changes geometry, or bends, in response to an applied voltage. The bending of the piezoelectric layer pressurizes ink in a pumping chamber located along the ink path.

Printing accuracy can be influenced by a number of factors, including the uniformity in size and velocity of ink drops ejected by the nozzles in the printhead and among the multiple printheads in a printer. The drop size and drop velocity uniformity are in turn influenced by factors, such as the dimensional uniformity of the ink paths, acoustic interference effects, contamination in the ink flow paths, and the uniformity of the pressure pulse generated by the actuators.

A typical liquid used in a fluid deposition device, e.g., an inkjet printer, is ink. However, other fluids can be deposited, for example, electroluminescent material used in the manufacture of liquid crystal displays or liquid metals used in circuit board fabrication.

SUMMARY

An apparatus and system for depositing a fluid on a substrate is described. In general, in one aspect, the invention features a fluid deposition device including a platen and a cartridge mount assembly. The platen is configured to support a substrate. The cartridge mount assembly includes a receptacle configured to receive a print cartridge configured to deposit a fluid on the substrate. The receptacle includes a plurality of electrical contacts configured to mate with a plurality of electrical contacts on the print cartridge and a vacuum connector configured to mate with a vacuum inlet included on the print cartridge. The receptacle is configured such that when a print cartridge is inserted into the receptacle, connections between the print cartridge and the receptacle's electrical contacts and vacuum connector are formed at substantially the same time.

Implementations of the fluid deposition device can include one or more of the following features. The platen can be configured to advance in a first direction and the cartridge mount assembly configured to advance in a second direction that is substantially perpendicular to the first direction. The cartridge mount assembly can be further configured to move in a third direction that is substantially perpendicular to the first and the second directions.

The fluid deposition device can include the print cartridge configured to deposit a fluid on the substrate and to be received within the receptacle, the print cartridge including: one or more nozzles configured to eject the fluid; a plurality of electrical contacts configured to mate with the plurality of electrical contacts of the receptacle; and a vacuum inlet configured to mate with the vacuum connector of the receptacle. The relative positions of the electrical contacts and vacuum connector of the receptacle and the electrical contacts and vacuum inlet of the print cartridge are such that the electrical and vacuum connections between the two are formed at substantially the same time when the print cartridge is inserted into the receptacle.

The fluid deposition device can further include a processor configured to provide signals to fire the one or more nozzles included in the print cartridge. The electrical contacts included in the receptacle can be electrically connected to the processor and configured to provide signals received from the processor to the print cartridge. The fluid deposition device can further include a frame, wherein the cartridge mount assembly is mounted to the frame and positioned above the platen. In one implementation, the fluid deposition device includes a housing, wherein the platen and the cartridge mount assembly are contained within the housing providing a substantially clean and contamination free zone.

The platen can include one or more apertures in communication with a vacuum source and configured to vacuum chuck the substrate to the platen. The cartridge mount assembly can further include a cap pivotable between an opened position and a closed position, where in the closed position the cap creates a seal around a nozzle region of the print cartridge and in the opened position the cap does not contact the nozzle region of the print cartridge. The cap can include a porous member configured to absorb fluid deposited from one or more nozzles included in the nozzle region.

In general, in another aspect, the fluid deposition device includes a platen configured to support a substrate and a cartridge mount assembly. The cartridge mount assembly includes a receptacle configured to receive a print cartridge configured to deposit a fluid on the substrate and a cap pivotable between an opened position and a closed position. In the closed position the cap creates a seal around a nozzle region of the print cartridge and in the opened position the cap does not contact the nozzle region of the print cartridge.

Implementations of the fluid deposition device can include one or more of the following features. The cartridge mount assembly can be configured to move in a first direction to increase and decrease a distance between a print cartridge mounted in the cartridge mount assembly and a substrate supported on the platen. The cartridge mount assembly moves in the first, direction to provide clearance for the cap when the cap pivots between the opened and the closed positions. The cap can include a porous member configured to absorb fluid deposited from one or more nozzles included in the nozzle region.

The invention can be implemented to realize one or more of the following advantages. The cartridge mount can be configured to receive single-use print cartridges suitable for testing inks or other fluids to be deposited on a substrate. A cap included in the cartridge mount permits capping on the fly, there reducing loss of printing fluid, e.g., through evaporation. The print cartridge can be capped at any position. An embodiment of the cap can allow the nozzles to continuously fire while capped, to prevent the fluid from drying up at the nozzles or otherwise changing viscosity. Keeping the nozzles "wet" by repeatedly firing them even while capped can improve nozzle firing, dot placement and repeatability. The cartridge mount can receive a single-use print cartridge and make electrical and vacuum connections to the print cartridge in one step at substantially the same time.

Details of one or more implementations are set forth in the accompanying drawings and the description below. Other features and advantages may be apparent from the description and drawings, and from the claims.

DRAWING DESCRIPTIONS

These and other aspects will now be described in detail with reference to the following drawings.

FIGS. 3A-E show a cartridge mount assembly of the fluid deposition device of FIG. 1.

Figure 3A:
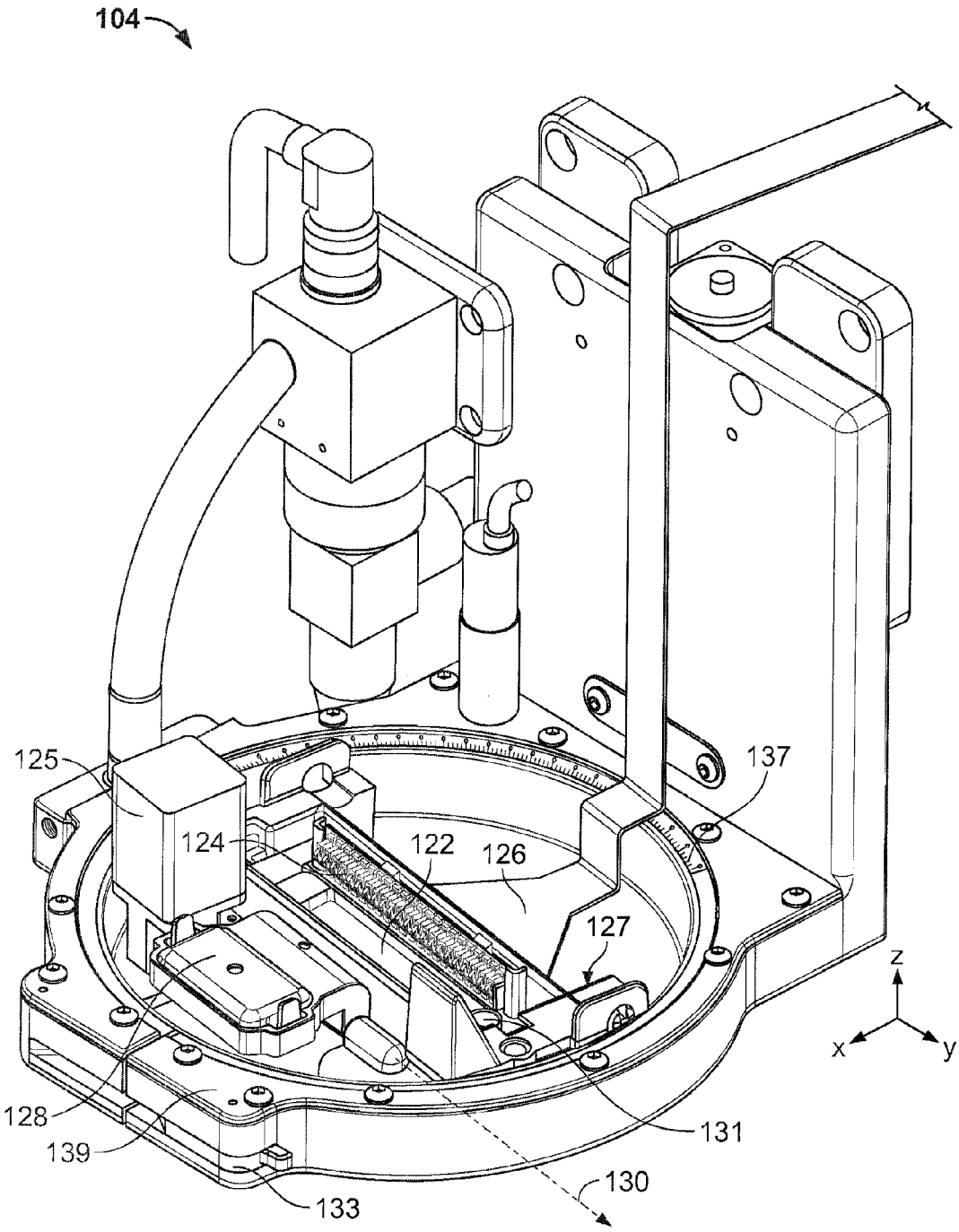
Figure 3B:
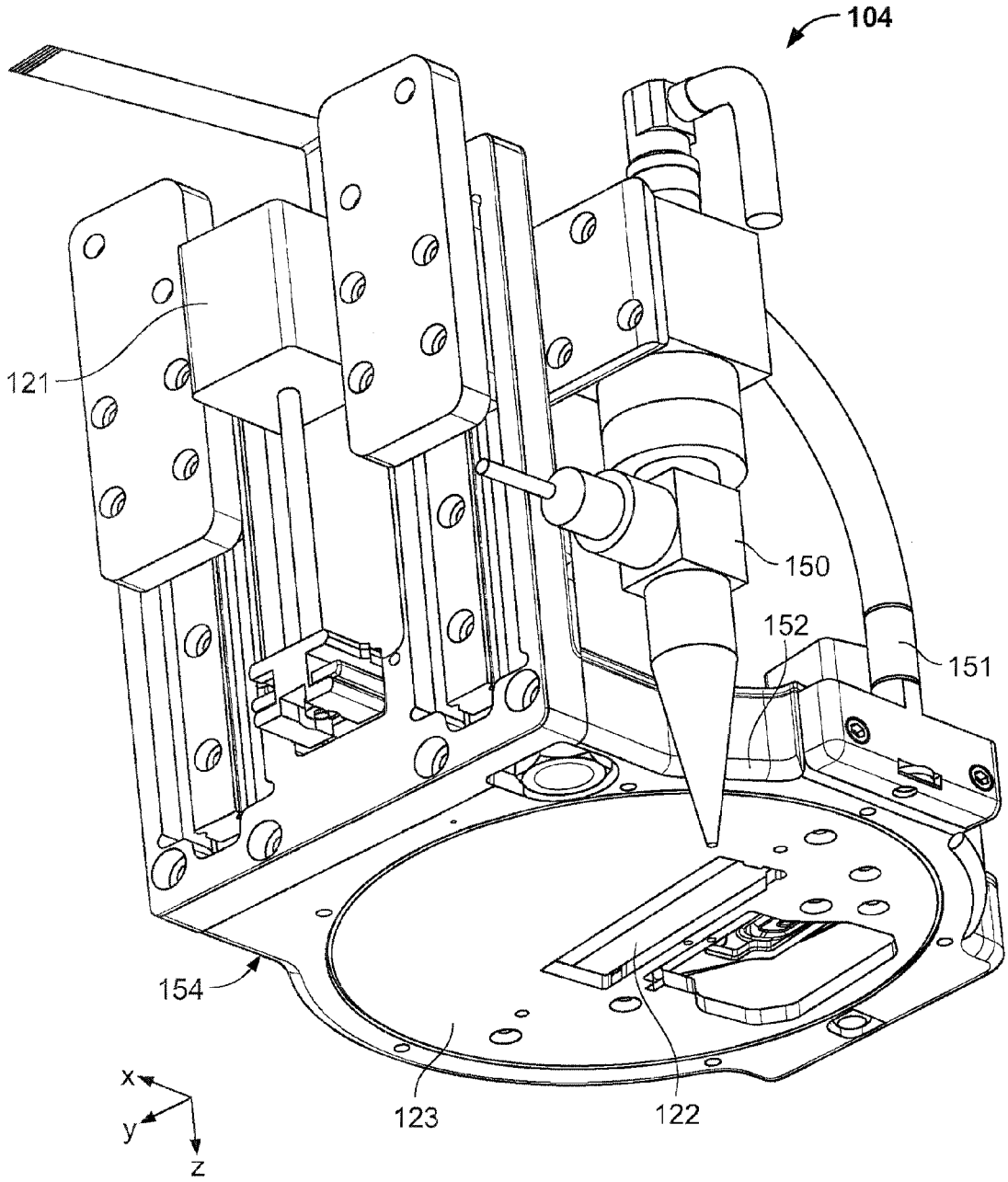
Figure 3C:
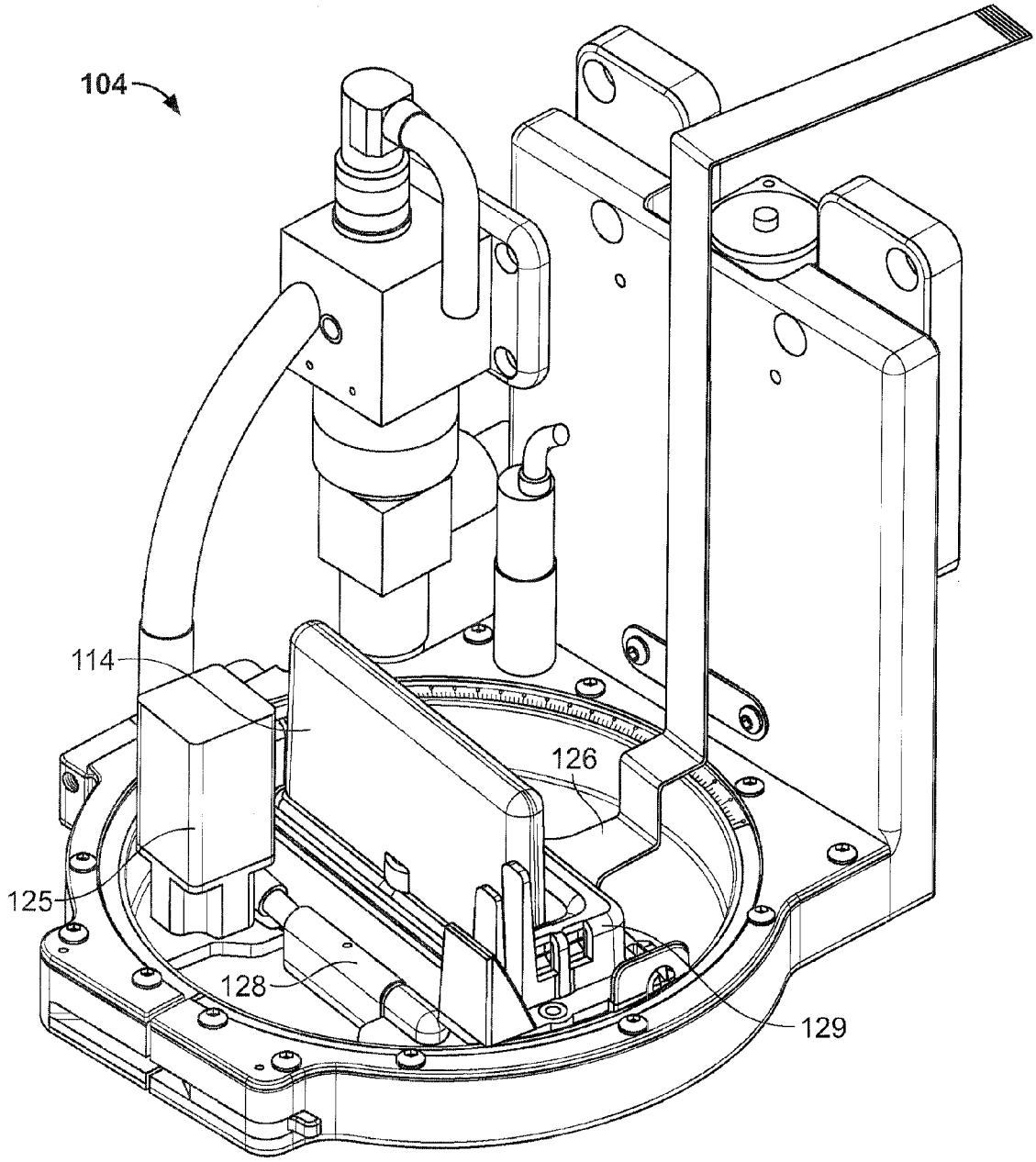
Figure 4A:
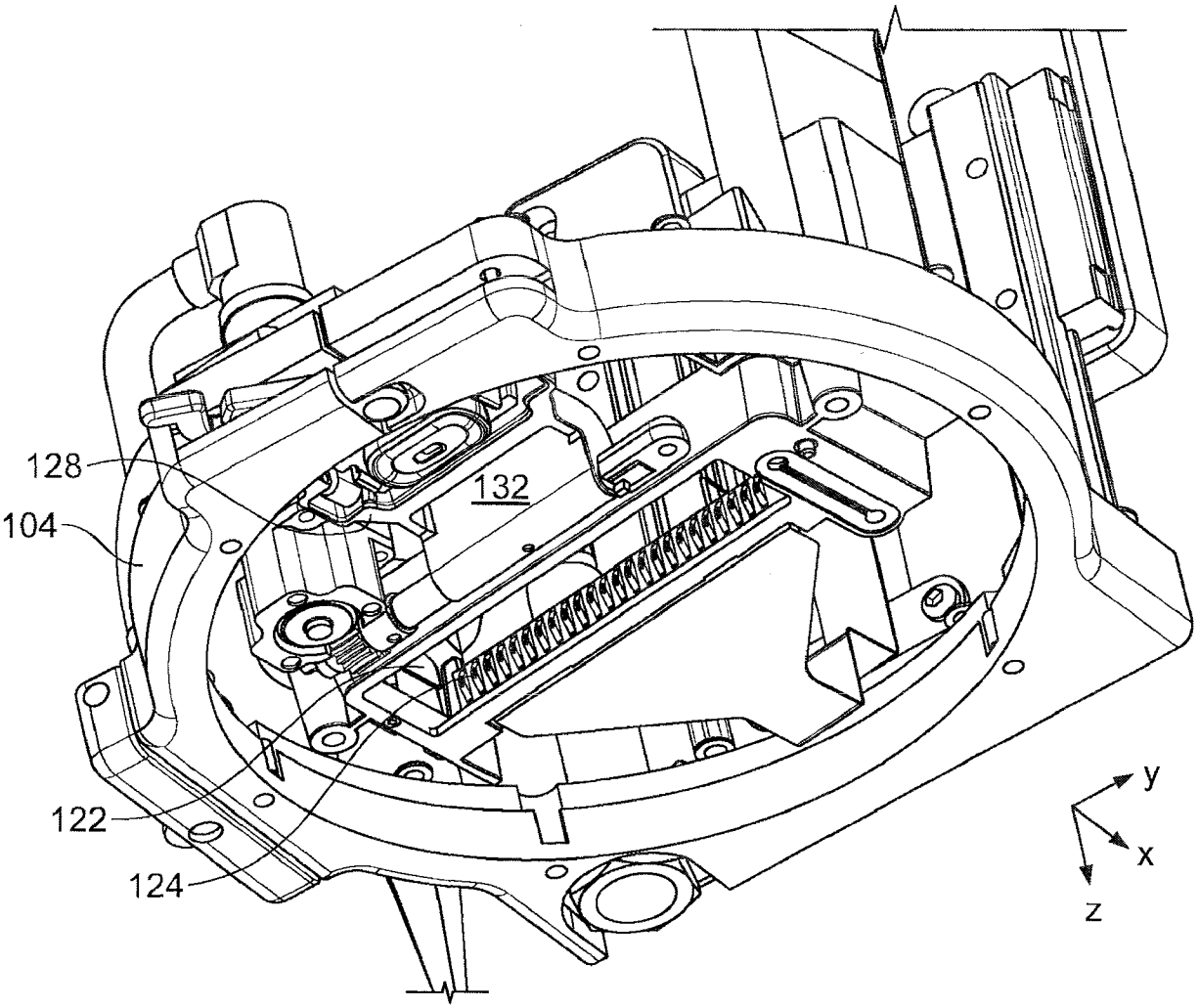
Figure 4B:
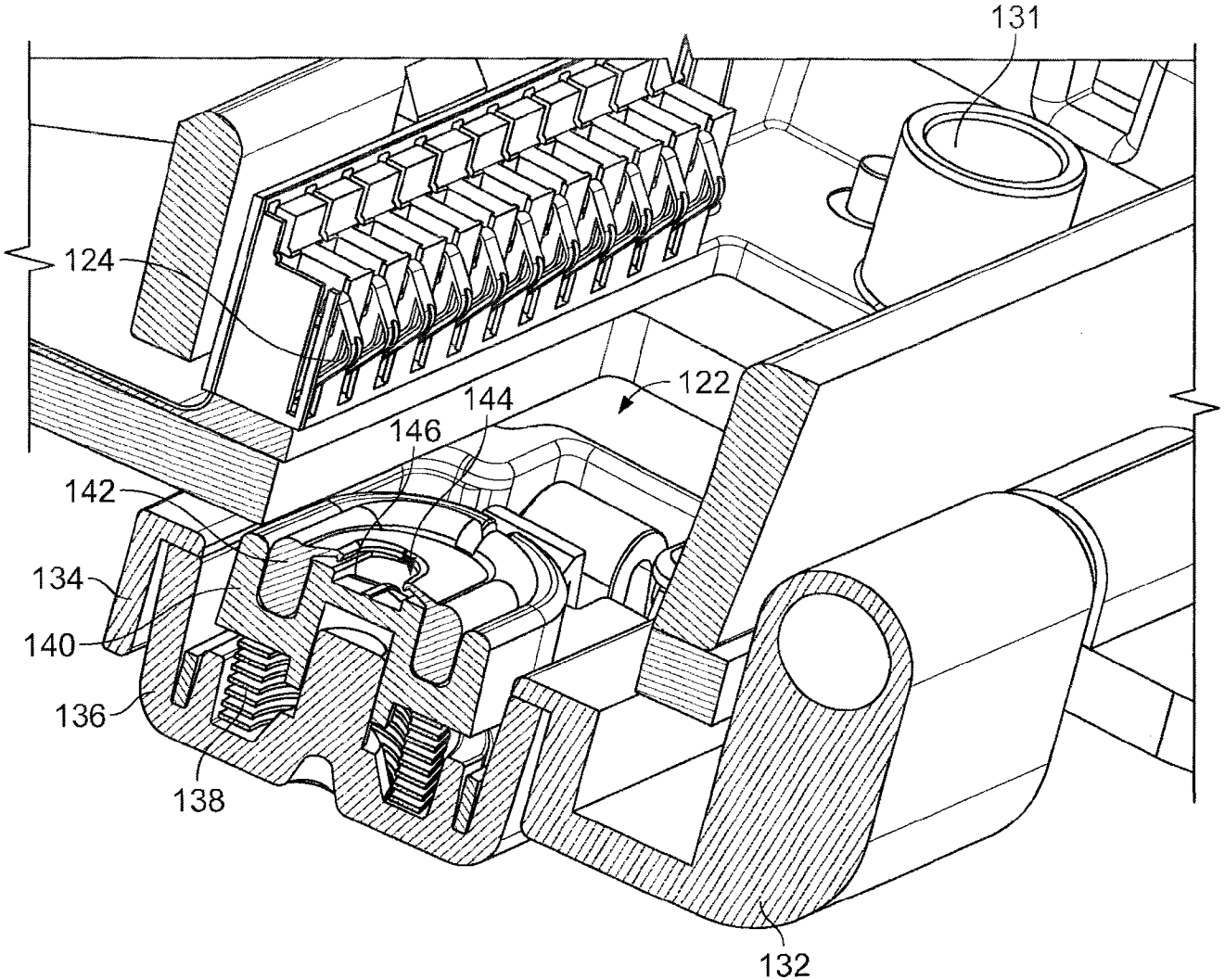

FIGS. 4A-B show a cap assembly included in the cartridge mount assembly of FIGS. 3A-C.

Figure 5A:
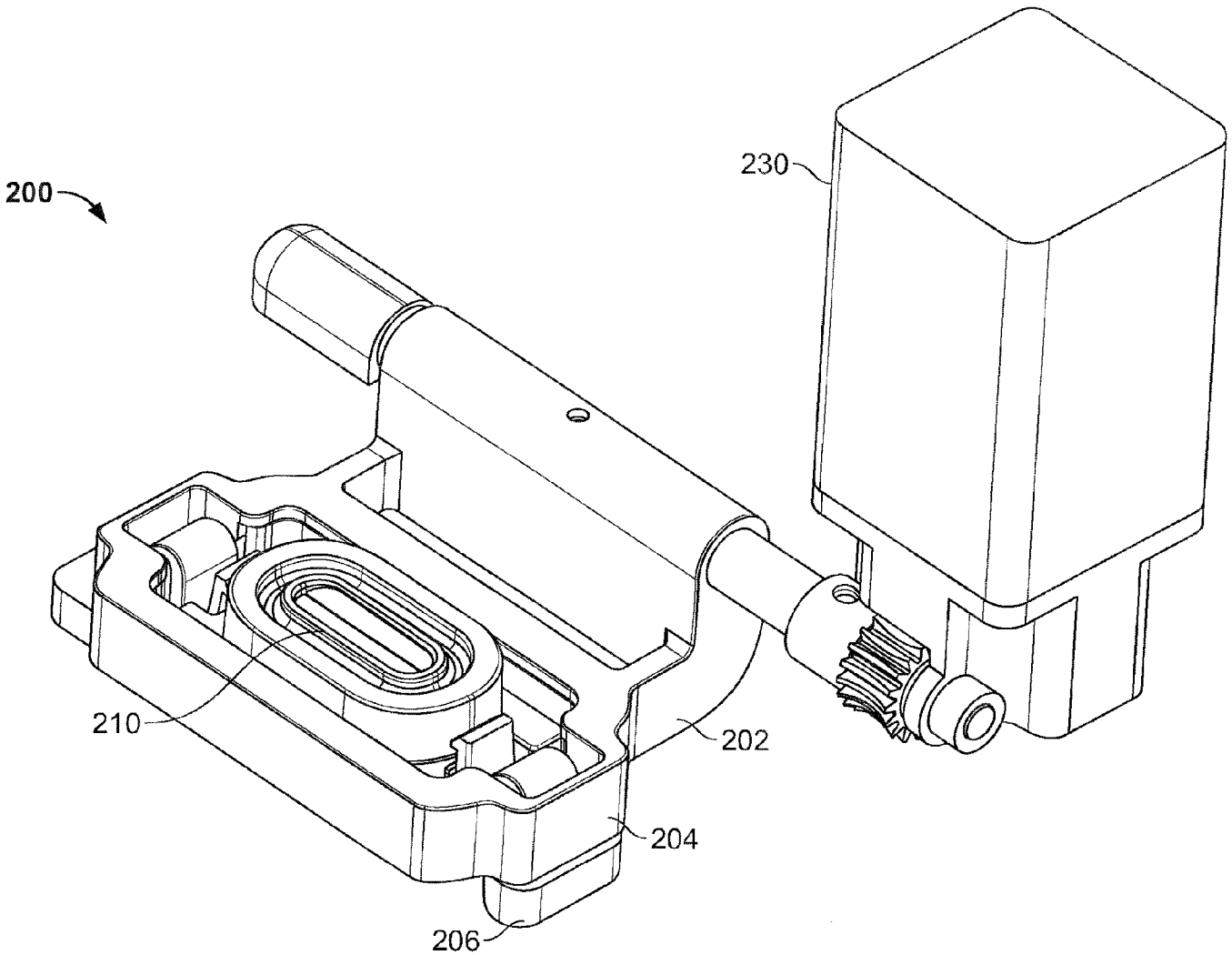
Figure 5B:
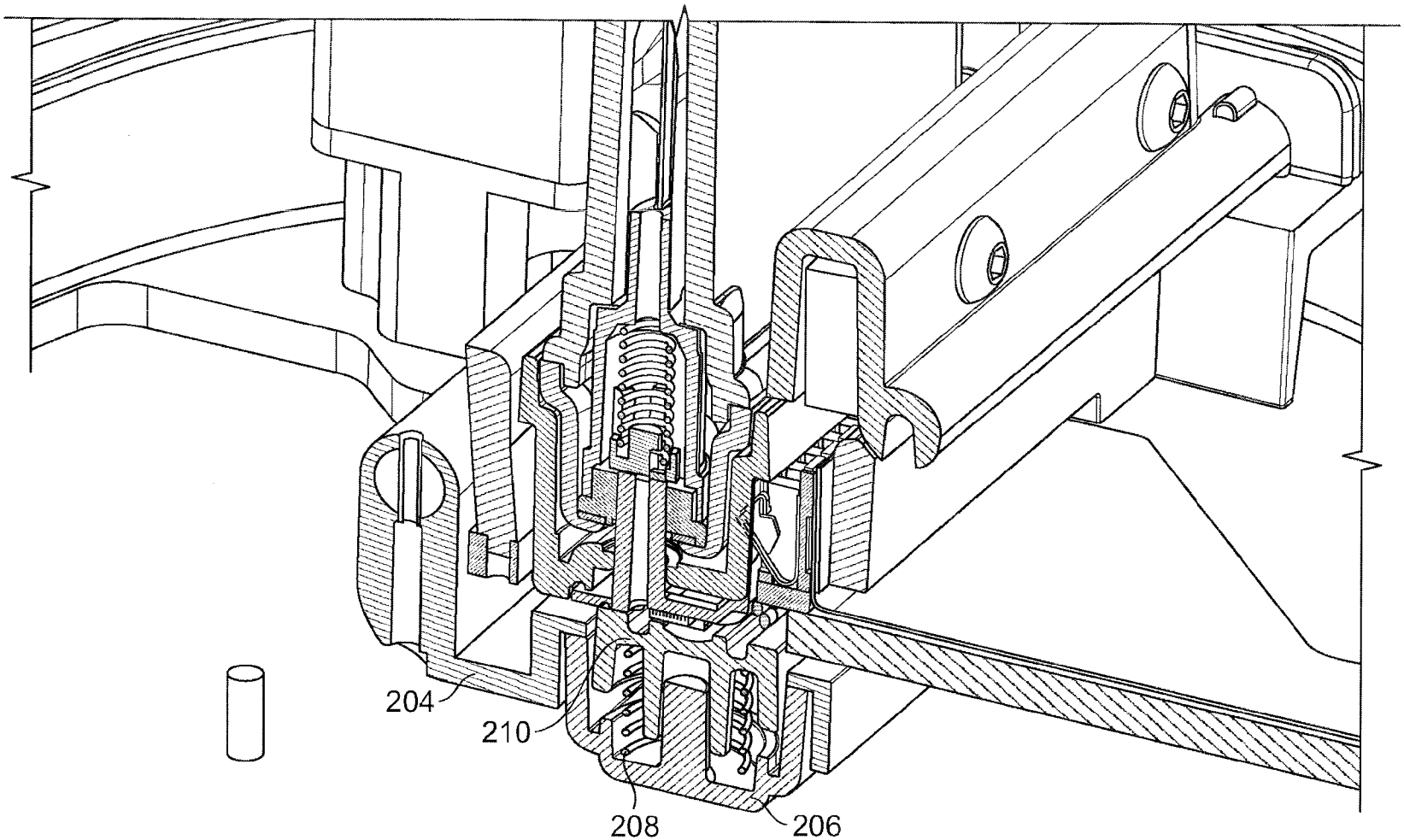
Figure 5C:
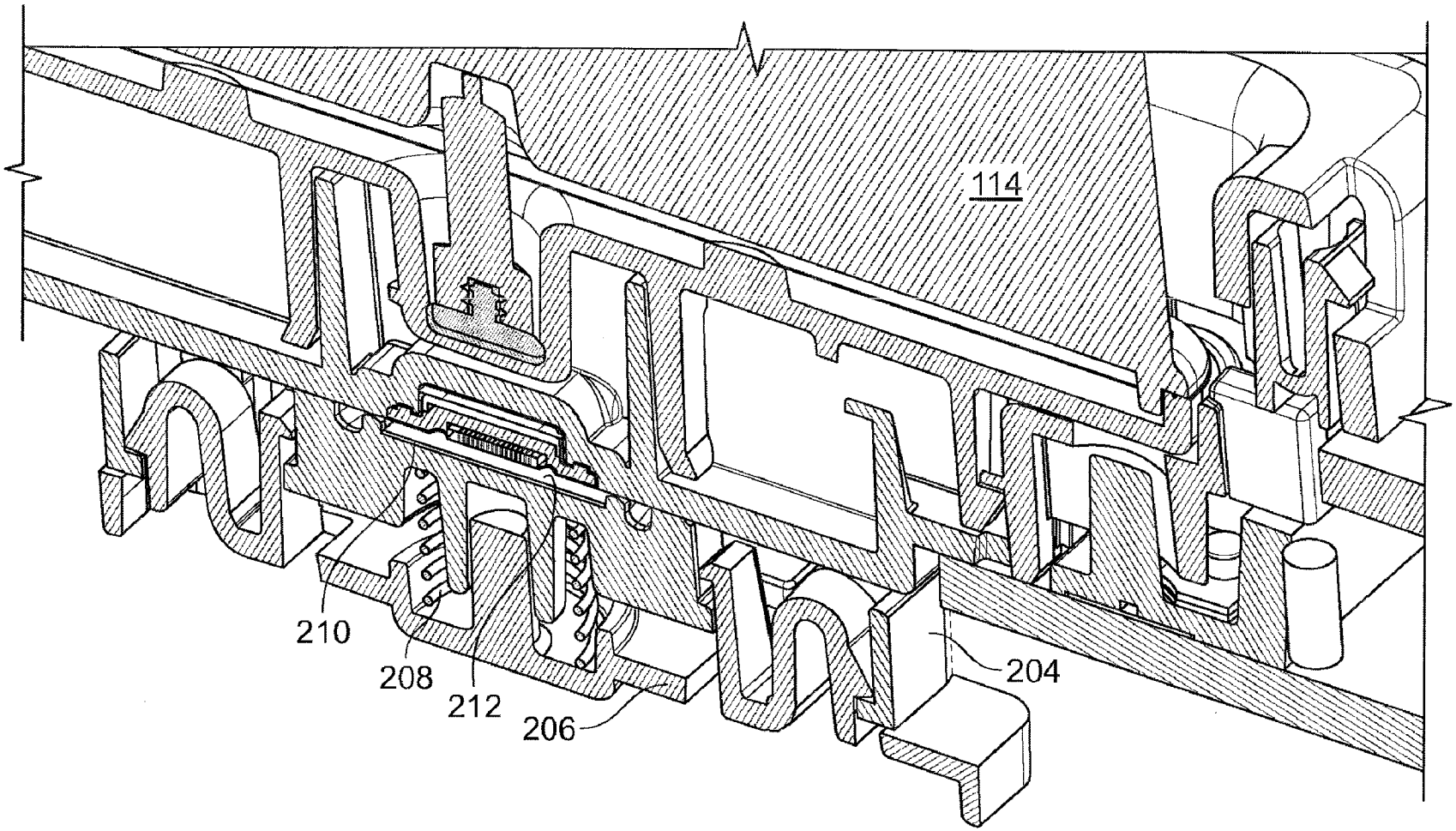

FIGS. 5A-C show an alternative cap assembly included in the cartridge mount assembly of FIGS. 3A-C.

Like reference symbols in the various drawings indicate like elements.

DETAILED DESCRIPTION

A fluid deposition device is described that includes a cartridge mount for mounting a print cartridge and a platen for supporting a substrate upon which a fluid is to be deposited. The print cartridge and substrate move relative to one another during a print operation. In one implementation, the print cartridge passes over a stationary substrate, and in another implementation the print cartridge remains stationary while the substrate advances. It should be noted that a print cartridge is sometimes referred to as a drop ejection module, printhead module, or otherwise.

Figure 1A:
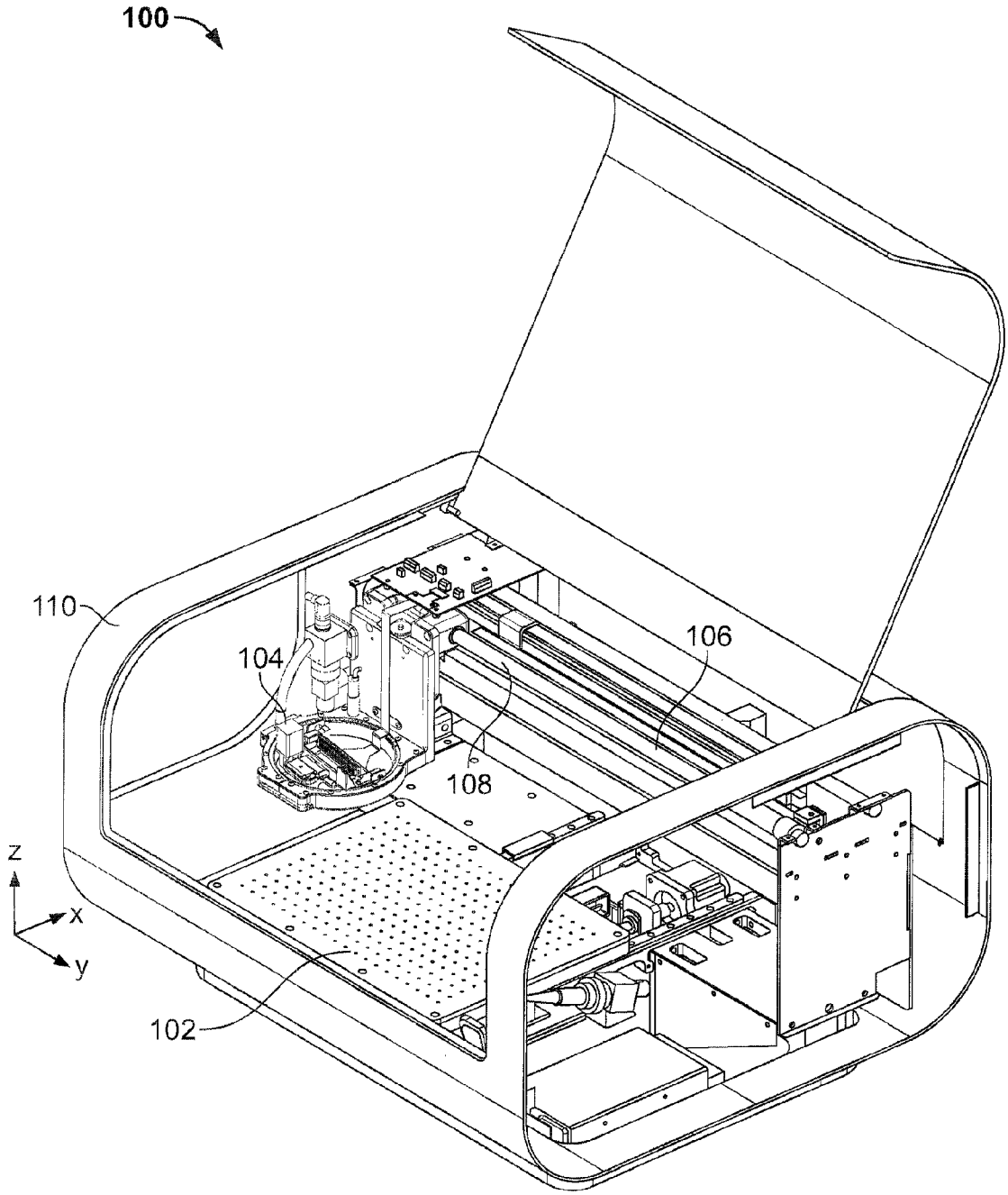
FIG. 1A shows a fluid deposition device.

Referring to FIG. 1A, one embodiment of a fluid deposition device 100 is shown. The fluid deposition device 100 includes a platen 102 configured to support a substrate during a print operation. A cartridge mount assembly 104 is attached to a frame 106 and positioned above the platen 102. The cartridge mount assembly 104 can translate along a rail 108 in the y-direction, providing movement relative to a substrate positioned on the platen 102. Additionally, the cartridge mount assembly 104 can move upward and downward relative to the platen 102, i.e., in the z-direction, to provide relative vertical movement between a print cartridge mounted therein and the substrate.

The platen 102 is configured to advance forward and backward in the x-direction. For example, after the cartridge mount assembly 104 has made a first pass of the substrate (i.e., translated the whole or a partial distance along the width of the substrate in the y-direction), the platen 102 can advance in the x-direction. When the cartridge mount assembly 104 does a next pass of the substrate, the print cartridge will deposit fluid on a different portion of the substrate. The fluid deposition device 100 is shown enclosed within a housing 110. The housing 110 is optional, and can be used to provide a substantially clean, contamination free zone for a print operation to occur.

Figure 1B:
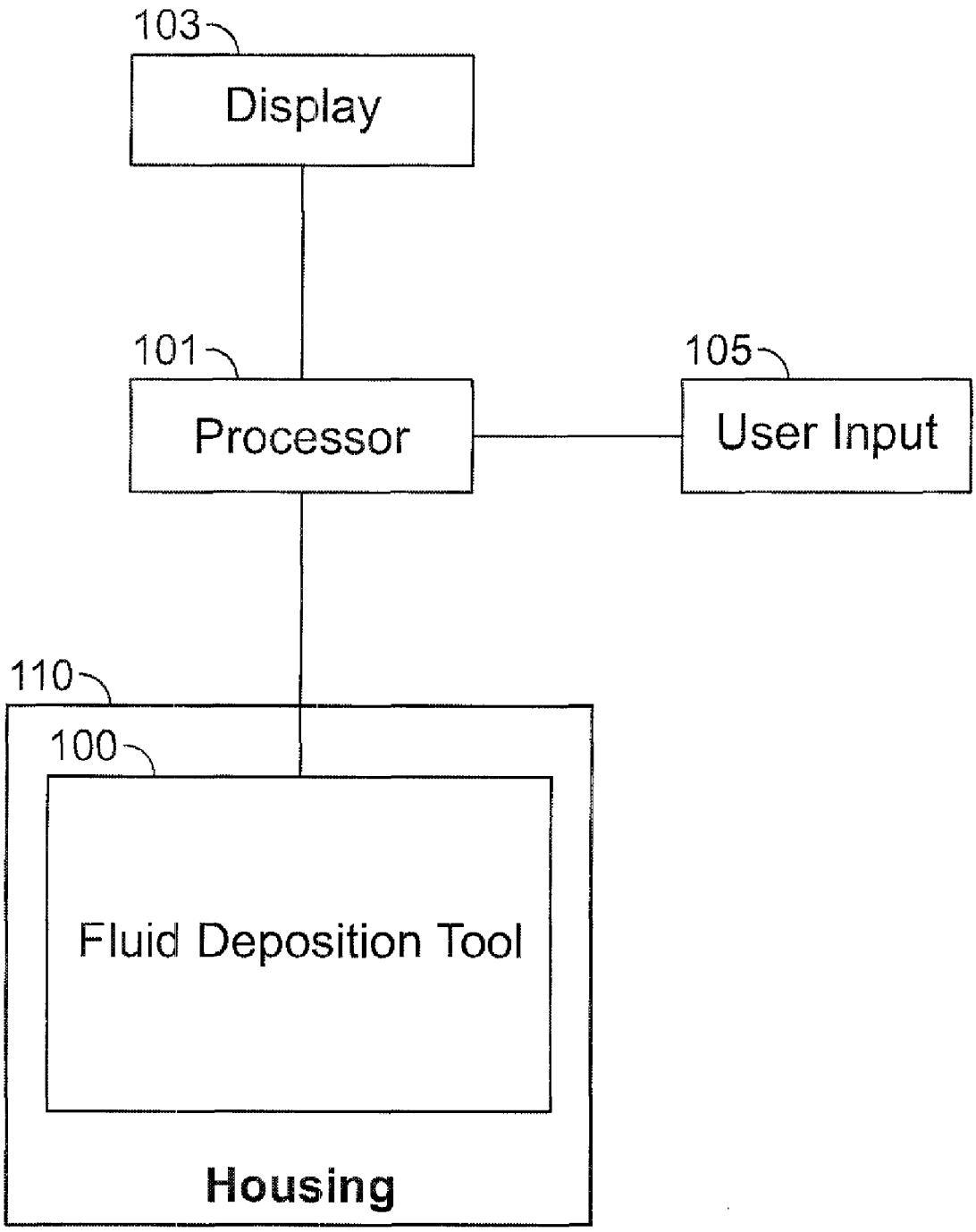
FIG. 1B shows a schematic representation of a fluid deposition device coupled to a processor.

Referring to FIG. 1B, a schematic representation of the fluid deposition device 100 within the housing 110 is shown. In this implementation, the fluid deposition device 100 is coupled to a processor 101. The processor 101 can be connected to a display 103 (e.g., a monitor) and a user input device 105 (e.g., a keyboard and/or mouse). The processor 101 can provide instructions to various components of the fluid deposition device 100, as shall be described further below. The display 103 and user input device 105 can allow a user to input operation parameters and make adjustments to a fluid deposition process, as well as view feedback provided by the processor 101, as described further below.

Figure 2:
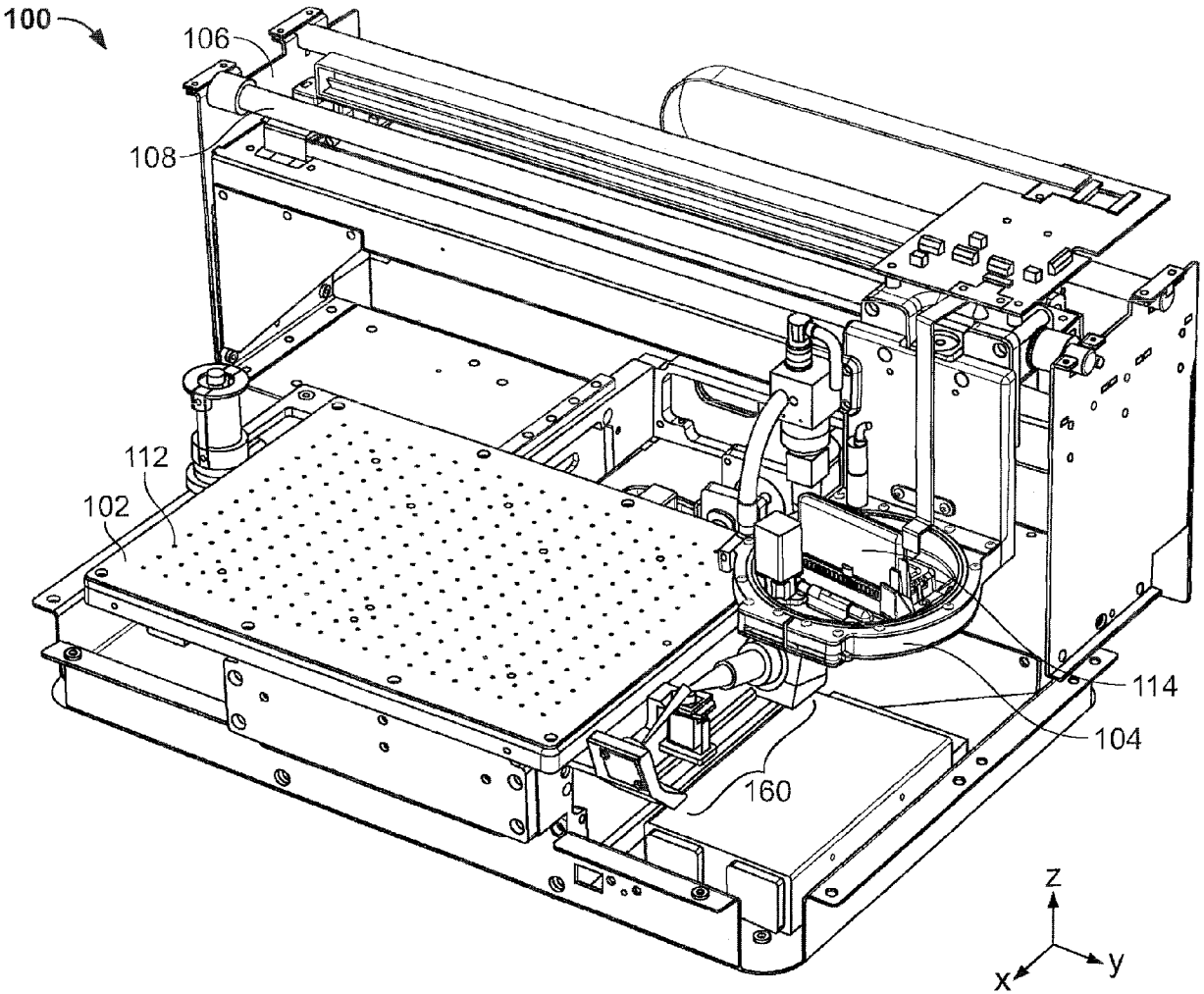
FIG. 2 shows the fluid deposition device of FIG. 1A without the housing.

Referring to FIG. 2, an enlarged view of the fluid deposition device 100 without the optional housing 110 is shown. The platen 102 includes multiple apertures 112 connected to a vacuum source. The vacuum source and apertures 112 can operate to vacuum chuck a substrate to the platen 102. In other implementations, other techniques can be used to secure the substrate to the platen 102, including, for example, clips or screws. The platen 102 is configured to advance incrementally in the x-direction. A motor is included within the fluid deposition device 100 beneath the platen 102 and operates to advance the platen 102 forward and backward in the x-direction. For example, in one implementation the motor can be positioned beneath the platen 102 and include a lead screw on the motor's shaft. The lead screw is anchored to the underside of the platen 102, and as the lead screw translates along the shaft, the platen 102 is pushed or pulled in the x-direction. The platen 102 can move along guide rails to ensure the platen 102 moves in the x-direction.

Additionally, a linear encoder can be included beneath the platen 102 to monitor the position of the platen 102. The accuracy of the encoder is matched to the accuracy requirements of the ink dot placement. For example, for relatively high resolution printing, a linear encoder accurate to approximately five microns can be used. In one implementation, the platen 102 can include lift pins configured to lift a substrate off the platen's upper surface to facilitate a robot picking up the substrate from the platen 102. The lift pins may or may not be retractable into the platen so as to position the substrate substantially flat against the platen during a fluid deposition operation.

The cartridge mount assembly 104 is shown in a rest position off to one side of the platen 102. A print cartridge 114 is shown mounted within the cartridge mount assembly 104. The cartridge mount assembly 104 can translate in the y-direction along the rail 108 by way of a motor attached to the frame 106 and including a belt extending substantially the length of the rail 108. The belt is anchored to the cartridge mount assembly 104 and pulls the cartridge mount assembly 104 back and forth in the y-direction along the rail 108 as the motor's shaft (coupled to the belt) rotates. Other configurations of motor assembly can be used, including different placement of the motor.

FIGS. 3A-C show enlarged views of the cartridge mount assembly 104. In this implementation, the cartridge mount assembly 104 is configured to mount a single-use print cartridge 114 shown in FIG. 3C. For example, the single-use print module described in U.S. patent application Ser. No. 11/305,824, entitled "Single-Use Droplet Ejection Module", filed Dec. 16, 2005, by Bibl et al, the entire contents of which are hereby incorporated herein by reference, can be mounted in the cartridge mount assembly 104, although differently configured print-cartridges (whether single-use or reusable) can also be used.

Referring particularly to FIG. 3A, the cartridge mount assembly 104 is shown without the print cartridge 114 mounted therein. The cartridge mount assembly 104 includes a receptacle 122 configured to receive the print cartridge 114. The receptacle 122 includes a number of electrical contacts 124 that are configured and positioned to mate with corresponding electrical contacts included on the print cartridge 114. When the print cartridge 114 is mounted within the receptacle 122, the electrical contacts 124 in the receptacle mate with the corresponding electrical contacts on the print cartridge 114, providing a pathway for electrical signals from the cartridge mounting assembly 104 to the print cartridge 114. The electrical contacts 124 included in the receptacle 122 are electrically connected to a flexible circuit 126 that can be connected directly or indirectly to a processor (e.g., processor 101, FIG. 1B) providing signals to fire the one or more nozzles included in the print cartridge 114.

Figure 3D:
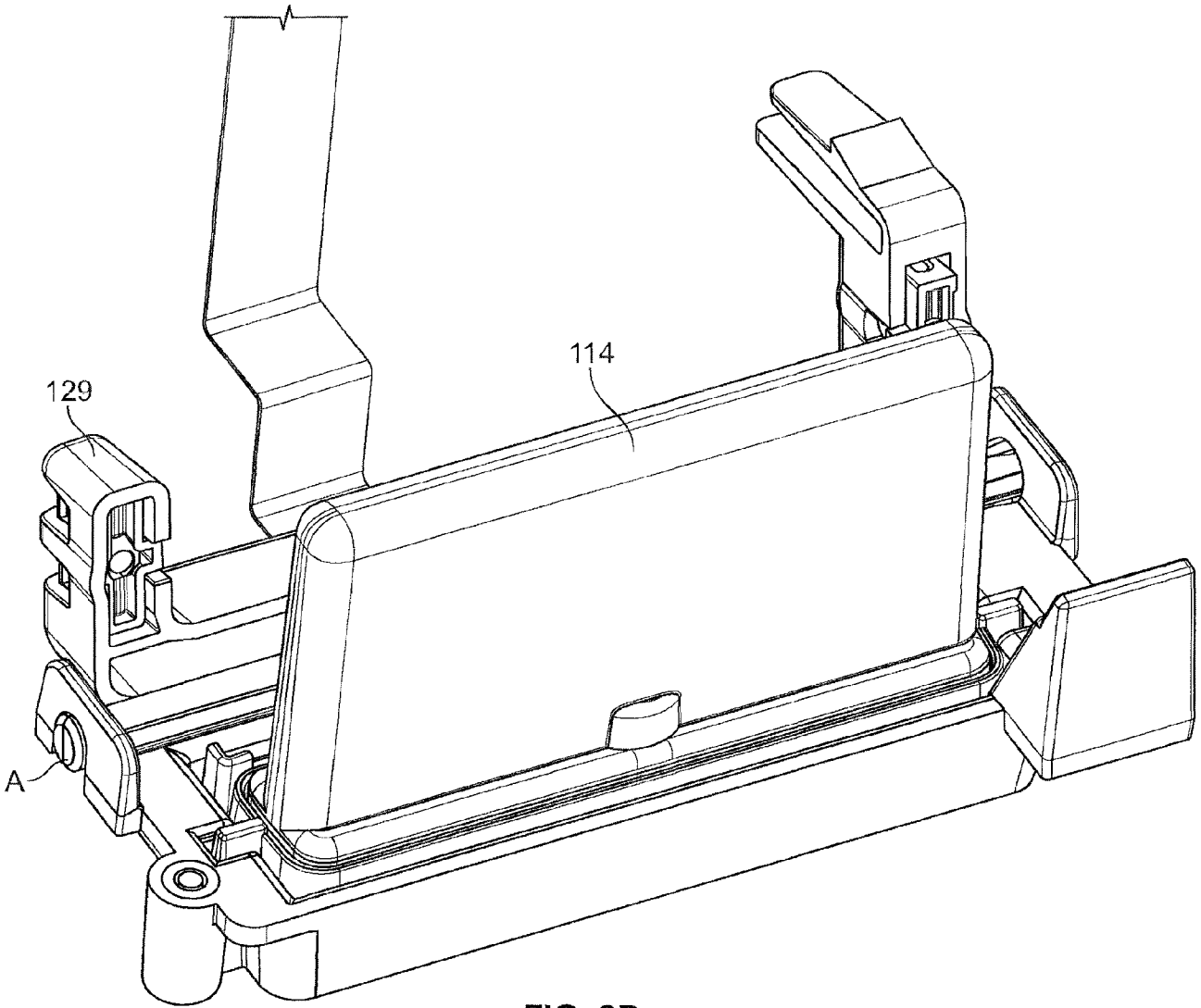
Figure 3E:
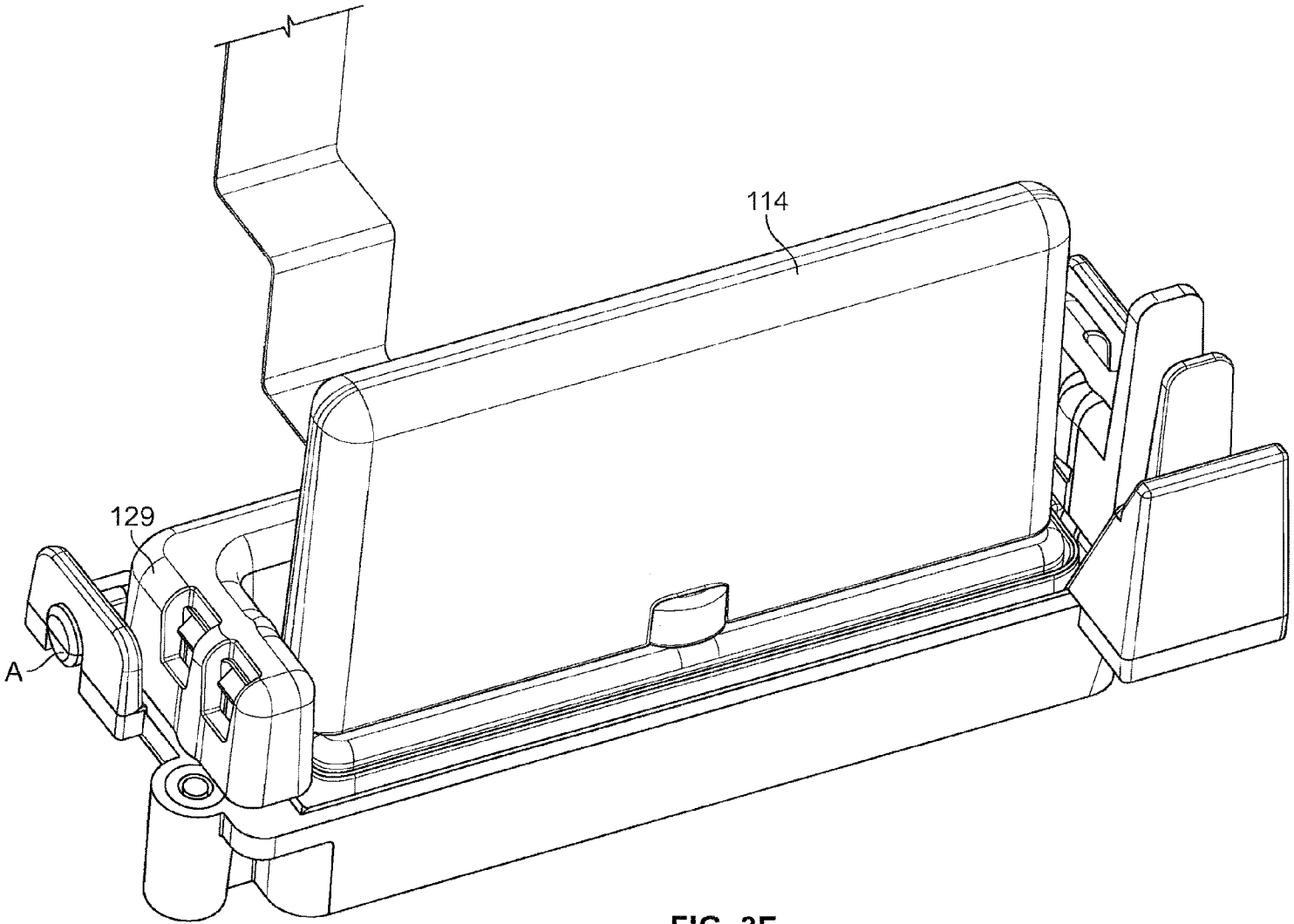

The electrical contacts 124 can be formed from a resilient, conductive material. Referring to FIG. 4B, an enlarged cross-sectional view of a portion of the cartridge mount assembly 104 is shown, including an enlarged view of the electrical contacts 124. Referring again to FIG. 3C, the print cartridge 114 is shown mounted in place within the receptacle 122. Once the print cartridge 114 is positioned in place, a pivoting latch 129 can be rotated into a locking position to secure the print cartridge 114 in place within the receptacle 122. For illustrative purposes, the latch 129 is not shown in FIG. 3A, so as not to obscure other features. Referring to FIGS. 3D and 3E, a partial view of the cartridge mount assembly 104 is shown to illustrate the latch 129. In FIG. 3D, the latch 129 is shown open and in FIG. 3E the latch 129 is shown in the closed position. The latch pivots about point A and can be held shut by a snap-fit connection or any other convenient connection.

Referring again to FIG. 3A, a vacuum connector 131 is shown positioned at an end of the receptacle 122. An enlarged view of the vacuum connector 131 is shown in FIG. 4B. The vacuum connector 131 is in communication with a vacuum source. In one implementation, the vacuum source is connected by a tube to a vacuum inlet positioned on the cartridge mount assembly 104 at approximately location 127 (FIG. 3A). The vacuum inlet is fluid coupled to the vacuum connector 131.

The relative positions of the electrical contacts 124 on the receptacle and the corresponding electrical contacts on the print cartridge 114, in conjunction with the relative positions of the vacuum connector 131 on the receptacle and the corresponding vacuum inlet on the print cartridge 114, are such that when the print cartridge 114 is inserted into the receptacle 122 the electrical connection between the electrical contacts 124 and corresponding contacts on the print cartridge 114, and the connection between the vacuum connector 131 and a corresponding vacuum inlet on the print cartridge 114, are formed at substantially the same time. The vacuum source can thereby provide a vacuum within the print cartridge's housing, providing back pressure to maintain a meniscus pressure at the nozzles and prevent leakage. By a single step of positioning the print cartridge 114 into place in the receptacle 122, a user can make both of these connections at substantially the same time.

Referring again to FIG. 3A, a cap 128 is included in the cartridge mount assembly 104. The cap 128 is pivotable about an axis 130. The cap 128 can be used to cap the nozzles included in the print cartridge 114 when the print cartridge 114 is not engaged in a print operation. Capping the print cartridge 114 can be important to reduce or eliminate evaporation of the fluid from the print cartridge 114, and to prevent leakage. During a print operation or when there is no desire to cap the print cartridge 114, the cap can remain in the "open" position shown in FIG. 3A. When there is a need to cap the print cartridge 114, the cap pivots about the axis 130 approximately 180° into the "closed" position shown in FIG. 3C.

Generally, during a print operation the cartridge mount assembly 104 is positioned relatively close to the substrate mounted on the platen 102. The distance between the nozzles included in the print cartridge 114 and the substrate can be referred to as the "flight height". The cartridge mount assembly 104 can be moved up and down vertically in the z-direction to adjust the flight height, or to adjust for changes in thickness of the substrate. In one implementation, a user can enter the substrate thickness into a user interface and the cartridge mount assembly 104 adjusts in the z-direction accordingly. Alternatively, the user can be presented with a high and a low flight height appropriate for the indicated substrate thickness, and the user can select the flight height. In another alternative, the user can input a specific flight height, and the cartridge mount assembly 104 adjusts accordingly.

Additionally, the cartridge mount assembly 104 can be moved upwardly in the z-direction a sufficient distance to provide clearance for the cap 128 to pivot about axis 130 into the closed position. In one implementation, when the cartridge mount assembly 104 receives an instruction to cap the print cartridge 114, either manually or automatically through the flexible circuit 126 connected to a processor (e.g., processor 101), the cartridge mount assembly 104 automatically moves upwardly in the z-direction a predetermined distance, pivots the cap 128 from the open to the closed position, and either lowers to the original position, or awaits further instructions. Because the cartridge mount assembly 104 would need to move the cap into the open position to resume the print operation, it can be more efficient to maintain the higher position, until receiving an instruction to switch the cap back into the open position.

Referring to FIGS. 4A and 4B, the cap 128 is shown in more detail. FIG. 4A shows the underside of the cartridge mount assembly 104 with the bottom panel 123 (shown in FIGS. 3A-C) removed to provide a better view of the cap 128, shown in the open position. FIG. 4B shows an enlarged cross-sectional view of a portion of the cartridge mount assembly 104, with the cap 128 in the closed position. The cap 128 includes pivot arm 132 configured to pivot the cap 128 between the open and closed positions. The pivot arm 132 is attached to an outer housing 134 that extends the perimeter of the cap 128. A motor 125 drives the pivot arm 132 between the open and closed positions. The motor 125 can be electrically connected to the flex circuit 126 to receive instructions from a processor (e.g., processor 101) coupled to the flex circuit 126 and/or from, a user interface coupled to the flex circuit 126.

A center portion 136 of the cap 128 is attached to the outer housing 134 and includes a recess within which a spring member 138 is positioned. The spring member 138 contacts a seal housing 140 and when the cap 128 is in the closed position, the spring member 138 urges the seal housing 140 and seal 142 positioned therein, into contact with the nozzle face of the print cartridge 114. The seal 142 is positioned within a groove formed in the seal housing 140 and is formed from a compressible material, e.g., an elastomer compatible with the printing fluid. The lip 144 formed in the upper surface of the seal 142 can be configured to form a liquid-tight seal around the region on the nozzle face of the print cartridge 114 that includes the nozzles. A cavity 146 is formed in the seal housing 140. The cavity 146 is relatively small, and can quickly become saturated with the fluid contained in the print cartridge 114. Once saturated, equilibrium is reached, and no more evaporation of the fluid from the printing cartridge 114 will occur. Accordingly, the amount of fluid lost due to evaporation during downtime (i.e., when not printing) can be minimized.

Referring to FIGS. 5A-C, an alternative embodiment of a cap 200 is shown. This implementation of the cap 200 is suitable for applications where the nozzles need to continue to fire while the cap 200 is in the closed position, e.g., to maintain the desired viscosity of the print fluid at the nozzles. The cap 200 includes pivot arm 202 configured to pivot the cap 200 between the open and closed positions. The pivot arm 202 is attached to an outer housing 204. A motor 230 drives the pivot arm 202 between the open and closed positions. The motor 230 can be electrically connected to the flex circuit 126 to receive instructions from a processor coupled to the flex circuit 126 and/or from a user interface coupled to the flex circuit 126.

A center portion 206 of the cap 200 is attached to the outer housing 204 and includes a recess within which a spring member 208 is positioned. The spring member 208 contacts a porous member 210 and when the cap 200 is in the closed position, the spring member 208 urges the porous member 210 at least partially into contact with the nozzle face of the print cartridge 114. The porous member can be substantially rigid and is formed from a porous material configured to absorb fluid deposited on the porous member 210 while the cap 200 is in the closed position and the nozzles are continuing to fire. In one implementation, the porous member 210 is made from a porous polymer known as XM1538 UHMWPE (UltraHigh Molecular Weight PolyEthylene) having an approximate pore size of 90-110 microns, available from Porex.

Referring particularly to FIG. 5B, the cap 200 is shown in a closed position against the nozzle face of a print cartridge 114. The porous member 210 is configured to collect and absorb fluid deposited on the porous member 210 by the nozzles while the cap 200 is closed. FIG. 5C shows a longitudinal, cross-sectional view of the cap 200 in the closed position against the print cartridge 114. A gap 212 is provided between the nozzles on the print cartridge 114 and the porous member 210 to provide clearance for the fluid to eject from the nozzles and collect on the porous member 210.

In one implementation, the cap 128 or 200 is driven into the closed position by a motor 125 or 230 having a worm gear drive (see FIG. 5A). The motor has a relatively large mechanical advantage and cannot be back driven. The motor drives the cap 128 rotationally until the cap 128 contacts the print cartridge 114 and then stops. Until the motor is instructed (e.g., by processor 101) to drive the cap 128 in the opposite direction to pivot the cap 128 into the open position, the cap 128 is held in the closed position by the motor.

Referring again to FIG. 2, the platen 102 can be configured to rotate about the z-axis to square the substrate relative to the printing cartridge 114. For example, a camera included in the fluid deposition device 100 can be used to detect an edge of the substrate. A processor (e.g., processor 101) coupled to the camera can determine the position of the substrate relative to the cartridge mount assembly 104. The processor can provide instructions, based on the determined position, to the motor coupled to the platen 102 to rotate the platen 102 accordingly to square the substrate relative to the cartridge mount assembly 104, and therefore relative to the print cartridge 114 therein.

In another implementation, the camera can look for fiducials (i.e., registration marks) on the substrate and align the substrate relative to the cartridge mount assembly 104 accordingly. In another implementation, the substrate can be aligned using the fiducials and a set of test dots can be printed onto the substrate. The camera can look at the print dots and determine their position relative the fiducials and re-align the substrate accordingly. Referring to FIG. 3B, one example of a camera 150 is shown. The camera 150 is attached to, and moves with, the cartridge mount assembly 104, making the capping feature significant, as the print cartridge 114 can remain capped while the cartridge mount assembly 104 traverses the substrate searching for fiducials, etc. The camera 150 can be electrically coupled, for example through the flex circuit 126, to the processor 101 shown in FIG. 1B.

Referring again to FIG. 3B, in one implementation the cartridge mount assembly 104 includes an ultraviolet light wand 151. The ultraviolet light wand 151 is useful for applications involving a printing fluid that must be immediately cured by ultraviolet light. The ultraviolet light wand 151 is mounted on the trailing edge 152 of the cartridge mount assembly 104, as opposed to the leading edge 154. In this implementation, a print operation only occurs when the cartridge mount assembly 104 is moving such that the leading edge 154 leads when traversing the substrate. The ultraviolet light wand 151 therefore trails and cures the printing fluid while passing over the fluid immediately after deposition onto the substrate. During the return stroke across the substrate, i.e., when the trailing edge 152 leads, the printing operation temporarily ceases. In one implementation the cap 128 can seal the nozzles during the return stroke.

Referring again to FIG. 2, a drop watcher camera system 160 is mounted to one side of the platen 102. The camera system 160 allows a user to watch fluid drops as they exit the print cartridge 114 and are printed on a test pad 162 positioned in front of the camera system 160. A strobed light source strobes 164 light at a speed approximately equal to the speed of the drops being fired from the nozzles. By strobing the light slightly out of phase with the nozzle firing, a series of pictures of a series of fluid drops in flight between the nozzle and the test pad 162 can be obtained. A composite of the series of pictures viewed together can give the illusion of a video clip of a single drop being ejected from a nozzle: in reality, the "video" is actually a composite of a series of still pictures taken of many different drops at slightly different stages of formation and flight.

In one implementation, the display 103 can be used to provide a graphical display to the user of the drops as captured by the camera system 160. Simultaneously, for example, using a split screen or multiple frames within a screen, a graphical representation of a waveform corresponding to the drive pulse to an actuator included in the print cartridge 114 to fire the nozzles can be displayed. The user can view the fluid drops and waveform and make adjustments as desired using the user input device 105. For example, the user can adjust the drive voltage delivered to the printhead within the print cartridge 114, duration of the voltage pulse, slope of the waveform, number of pulses, and other adjustable parameters. The user input is used by the processor 101, e.g., by a software application executing in the processor, to adjust the signals sent to the actuator or actuators located within the print cartridge 114.

Referring again to FIG. 3A, a calibrated guide 137 can be included on the cartridge mount assembly 104. A user can move latch cam 133 from the closed position shown to an open position. In the open position, the frame 139 of the lower portion of the cartridge mount assembly 104 is slightly released, and the components of the cartridge mount assembly 104 included within the perimeter formed by the calibrated guide 137 are rotatable about the z-axis. By rotating components of the cartridge mount assembly 104, including the receptacle 122 and therefore the position of a print cartridge 114 mounted therein, the print resolution can be adjusted. For example, consider a print cartridge 114 including a single row of nozzles arranged along the length of the print cartridge 114 in the x-direction. At zero rotation of the print cartridge 114, dots printed from the nozzles form a line in the x-direction. When rotated a few degrees, the dots can be printed closer to one another, and depending on the desired resolution, the angle of rotation of the print cartridge 114 relative to the cartridge mount assembly frame 139 can be adjusted. In one implementation, a Vernier scale is used to scale the calibrated guide 137, although other scales can be used.

In one implementation, the drop watcher camera system 160 can be used to determine the actual angle of the print nozzles as set by the user using the calibrated guide 137. The drop watcher camera system 160 can find coordinates of a position of a first nozzle and coordinates of a position of a second nozzle a known distance from the first nozzle. The processor 101, coupled to the drop watcher camera system 160, can thereby calculate the offset angle of the nozzles relative to one another. Knowing the actual angle, as compared to the angle the user believes he/she set the calibrated guide 137 to is significant, as the timing of dot placement can be dependent on the offset angle. Therefore, the more accurate the offset angle, the more accurate the timing delays when firing the nozzles, thereby improving the printing accuracy. The processor 101 (i.e., a software application executing in the processor) can use the actual angle to adjust the operating parameters, e.g., the drive signals to the print cartridge 114.

A number of references to functions that can be executed by the processor 101 are described above. It should be understood that more than one processor can be used, and reference to processor 101 is exemplary. Additionally, in one implementation, a user input device can be mounted directly onto the fluid deposition device 100, for example, as a touch pad and/or screen. Other forms of user input devices can also be used.

Elements of the fluid deposition device 100, including but not limited to, the processor 101, and at least some of the functional operations described in this specification can be implemented in digital electronic circuitry, or in computer software, firmware, or hardware, including the structural means disclosed in this specification and structural equivalents thereof, or in combinations of them. Elements of the fluid deposition device 100 can be implemented as one or more computer program products, i.e., one or more computer programs tangibly embodied in an information carrier, e.g., in a machine-readable storage device or in a propagated signal, for execution by, or to control the operation of, data processing apparatus, e.g., a programmable processor, a computer, or multiple processors or computers. A computer program (also known as a program, software, software application, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, subprograms, or portions of code). A computer program can be deployed to be executed on one computer or on multiple computers at one site or distributed across multiple sites and interconnected by a communication network.

The processes and logic flows described in this specification, including the method steps of the invention (e.g., squaring the substrate to the print cartridge, calculating the actual angle of rotation of the print cartridge, etc.), can be performed using one or more programmable processors (e.g., processor 101) executing one or more computer programs to perform functions of the invention by operating on input data and generating output. The processes and logic Glows can, also be performed by, and apparatus of the invention can be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio player, a Global Positioning System (GPS) receiver, to name just a few. Information carriers suitable for embodying computer program instructions and data include all forms of non-volatile memory, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, the invention can be implemented including a computer having a display device (e.g., display 103), e.g., a CRT (cathode ray tube) or LCD (liquid crystal display) monitor, for displaying information to the user and a keyboard and a pointing device, e.g., a mouse or a trackball, by which the user can provide input to the computer (e.g., user input device 105). Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

As previously mentioned, ink is just one example of a printing fluid. It should be understood that references to ink as the printing fluid are for illustrative purposes only, and referring to components within the printhead module described above with the adjective "ink" was also illustrative. Further, as previously mentioned, the fluid deposition cartridge has been referred to for illustrative purposes as a print cartridge 114, however, the use can be broader than printing operations per se, and can be used to eject drops of any sort of fluid for various purposes.

The use of terminology such as "front" and "back" and "top" and "bottom" throughout the specification and claims is for illustrative purposes only, to distinguish between various components of the fluid deposition device and other elements described herein. The use of "front" and "back", and "top" and "bottom" does not imply a particular orientation of the fluid deposition device of the elements included therein.

Although only a few embodiments have been described in detail above, other modifications are possible. Other embodiments may be within the scope of the following claims.

What is claimed is:

1. A fluid deposition device, comprising:

a platen configured to support a substrate;

a cartridge mount assembly including:

a receptacle configured to receive a print cartridge configured to deposit a fluid on the substrate, the receptacle including:

a plurality of electrical contacts configured to mate with a plurality of electrical contacts on the print cartridge;

a vacuum connector configured to mate with a vacuum inlet included on the print cartridge;

where the receptacle is configured such that when a print cartridge is inserted into the receptacle, connections between the print cartridge and the receptacle's electrical contacts and vacuum connector are formed at substantially the same time.

2. The fluid deposition device of claim 1, where the platen is configured to advance in a first direction and the cartridge mount assembly is configured to advance in a second direction that is substantially perpendicular to the first direction.

3. The fluid deposition device of claim 2, where the cartridge mount assembly is further configured to move in a third direction that is substantially perpendicular to the first and the second directions.

4. The fluid deposition device of claim 1, further comprising:

a print cartridge configured to deposit a fluid on the substrate and to be received within the receptacle, the print cartridge including:

one or more nozzles configured to eject the fluid;

a plurality of electrical contacts configured to mate with the plurality of electrical contacts of the receptacle; and a vacuum inlet configured to mate with the vacuum connector of the receptacle;

where the relative positions of the electrical contacts and vacuum connector of the receptacle and the electrical contacts and vacuum inlet of the print cartridge are such that the electrical and vacuum connections between the two are formed at substantially the same time when the print cartridge is inserted into the receptacle.

5. The fluid deposition device of claim 4, further comprising:

a processor configured to provide signals to fire the one or more nozzles included in the print cartridge;

wherein the electrical contacts included in the receptacle are electrically connected to the processor and are configured to provide signals received from the processor to the print cartridge.

6. The fluid deposition device of claim 1, further comprising:

a frame;

wherein the cartridge mount assembly is mounted to the frame and positioned above the platen.

7. The fluid deposition device of claim 1, further comprising:

a housing, wherein the platen and the cartridge mount assembly are contained within the housing.

8. The fluid deposition device of claim 1, wherein the platen includes one or more apertures in communication with a vacuum source and configured to vacuum chuck the substrate to the platen.

9. The fluid deposition device of claim 1, wherein the cartridge mount assembly further comprises:

a cap pivotable between an opened position and a closed position, where in the closed position the cap creates a seal around a nozzle region of the print cartridge and in the opened position the cap does not contact the nozzle region of the print cartridge.

10. The fluid deposition device of claim 9, wherein the cap includes a porous member configured to absorb fluid deposited from one or more nozzles included in the nozzle region.

* * * * *